United States Patent [19]

Kawasaki

[11] Patent Number: 4,617,435

[45] Date of Patent: Oct. 14, 1986

[54] HYBRID CIRCUIT BREAKER

[75] Inventor: Yutaka Kawasaki, Miura, Japan

[73] Assignee: Kabushiki Kaisha Toshiba, Kawasaki, Japan

[21] Appl. No.: 753,777

[22] Filed: Jul. 11, 1985

[30] Foreign Application Priority Data

Aug. 28, 1984 [JP] Japan ..... 59-178643

[51] Int. Cl.[4] ..... H01H 33/16

[52] U.S. Cl. ..... 200/144 AP; 200/145

[58] Field of Search ..... 200/144 AP, 145

[56] References Cited

U.S. PATENT DOCUMENTS

| | | | |
|---|---|---|---|
| 3,863,041 | 1/1975 | Rostron et al. | 200/144 AP |
| 4,087,664 | 5/1978 | Weston | 200/145 |
| 4,204,101 | 5/1980 | Dethlefsen | 200/144 AP |
| 4,555,603 | 11/1985 | Aoyama | 200/145 |

FOREIGN PATENT DOCUMENTS

| | | | |
|---|---|---|---|
| 346301 | 11/1920 | Fed. Rep. of Germany | 200/144 AP |
| 590343 | 3/1925 | France | 200/144 AP |

*Primary Examiner*—Robert S. Macon

*Attorney, Agent, or Firm*—Oblon, Fisher, Spivak, McClelland & Maier

[57] ABSTRACT

A hybrid circuit breaker is formed with a vacuum interrupter, a breaking resistor connected in parallel to the vacuum interrupter, an $SF_6$ gas interrupter connected in series to the breaking resistor and a spring mechanism for actuating the vacuum interrupter so that a circuit current to be interrupted is commutated to the breaking resistor. A plurality of the above hybrid circuit breakers are connected in series in an EHV/UHV electric power system. The spring mechanism is provided exclusively for the commutation action of the vacuum interrupter. The output power from a breaker driver is fully used to circuit-open the gas interrupter, thereby shortening the maximum current feeding period of the breaking resistor.

9 Claims, 18 Drawing Figures

HYBRID CIRCUIT BREAKER

BACKGROUND OF THE INVENTION

The present invention relates to a hybrid circuit breaker being formed with a vacuum interrupter, a gas interrupter and a resistor which serves to suppress a transient recovery voltage generated when a circuit current is interrupted by circuit-opening of the breaker and also to suppress an overvoltage generated when the breaker is circuit-closed.

A circuit breaker is designed so as to prevent the occurrence of restriking at the time of current interruption and to ensure the state of current interruption. Accordingly, with respect to an overvoltage appearing in an electric power system, the system designer employing such a circuit breaker is required to consider only a transient recovery voltage generated at the time of current interruption.

For an electric power system with a rated voltage of 300 kV or less, the margin of dielectric strength is generally high enough. From this, an overvoltage due to the transient recovery voltage or an overvoltage caused by the breaker-closing can be restricted within a range of safety operation with respect to a coordination of insulation of the power system. Thus, no countermeasure is required to suppress an overvoltage caused by the opening or closing action of the circuit breaker.

In an electric power system of 500 kV rating, on the other hand, the coordination of insulation depends on the consideration of a cost performance or economy for the system construction, and the limit of dielectric strength of the system insulation (or the system insulation level) is generally set at about double the nominal operating voltage with respect to the ground potential. In view of this, a making resistor is adapted to a circuit breaker of a 500 kV power system so that an overvoltage caused by the breaker-closing is effectively damped or suppressed, thereby achieving the overvoltage suppression.

In an extremely high voltage (EHV) or ultra high voltage (UHV) electric power system of 700 kV to 1000 kV ratings, further critical consideration for the coordination of insulation is required. Thus, the system insulation level is set at 1.5 to 1.6 of the nominal operating voltage with respect to the ground potential. Such a system insulation level is too low from a practical view point. Unless a transient recovery voltage caused by the current interrupting action of an EHV/UHV breaker is effectively suppressed, not only when an overvoltage due to the breaker-closing appears but even when restriking is prevented from the breaker action, it is practically impossible to avoid potential overshooting beyond the system insulation level. This fact requires the use of a making/breaking resistor through which both the closing and opening breaker actions are effected.

However, since a surge impedance of the power system decreases with an increase in the system voltage, the value of a making/breaking resistor for suppressing the overvoltage of an EHV/UHV system has to be reduced. This requires a large heat (or power) capacity to the making/breaking resistor. Thus, the size of the making/breaking resistor body becomes bulky, and the share of volume or cost of the resistor body in the EHV/UHV breaker becomes prominently high.

Meanwhile, in recent years, $SF_6$ gas interrupters are often utilized to a circuit breaker which is formed with a breaking resistor, a resistor commutating interrupter containing main contacts and a resistor current cutting-off interrupter containing resistor contacts, wherein each of these interrupters is actuated under prescribed controlled gas pressure. In such a circuit breaker, a current feeding period for the breaking resistor must be determined in accordance with both the arc time of the commutating interrupter and that of the cutting-off interrupter. This requires a further enlarged heat capacity to the resistor body.

FIG. 1 illustrates various voltage and current waveforms obtained under the rated gas pressure and under the interruption guaranteed gas pressure of a conventional $SF_6$ gas-blast circuit breaker which is formed with a breaking resistor, a resistor current cutting-off $SF_6$ interrupter connected in series to the breaking resistor and a resistor commutating $SF_6$ interrupter connected in parallel to the series circuit of the breaking resistor and the cutting-off interrupter.

In FIG. 1, the symbol v0 denotes an electric power system voltage applied to the breaker, v1 denotes a potential difference between resistor contacts of the resistor current cutting-off interrupter, and v2 denotes an arc voltage appearing across the main contacts of the resistor commutating interrupter. Further, i0 denotes a breaker current to be interrupted by the breaker action and i1 denotes a current flowing through the breaking resistor. In the illustration of FIG. 1, the i0 phase deviates by about 90 degrees from the v0 phase. The symbol i0* denotes another breaker current whose phase deviation from v0 is smaller than the phase deviation of i0 from v0. The symbol SX denotes the stroke of the main contacts of the commutating interrupter, and SR denotes the stroke of the resistor contacts of the cutting-off interrupter. The symbol TAmin* indicates the minimum arc time of the main contacts under the rated gas pressure of the commutating interrupter. TAmin indicates the minimum arc time of the main contacts under the interruption guaranteed gas pressure. TAmax indicates the maximum arc time of the main contacts under the interruption guaranteed gas pressure. TRmin indicates the minimum arc time of the resistor contacts under the interruption guaranteed gas pressure. TRmax indicates the maximum arc time of the resistor contacts under the interruption guaranteed gas pressure. TQ indicates the maximum current feeding period for the breaking resistor.

In the following, discussion will be given to a case wherein a current commutation for the breaking resistor and an interruption of a fault current i0 are effected by the above-mentioned $SF_6$ interrupters.

After delivering the interruption effecting power from a breaker driver (t0 in FIG. 1), both the commutating and cutting-off interrupters start to actuate (t1). Then, the main contacts of the commutating interrupter are opened (t2), and arcing appears at the main contacts. Such arcing disappears when breaker current i0 (or i0*) crosses the zero value (t3, t4 or t5). Suppose that the arcing of the main contacts disappears at time t5. Then, commutating interrupter is electrically circuit-opened and current i0 commutates to the breaking resistor (t5).

Thereafter, the resistor contacts of the cutting-off interrupter are opened (t6), and arcing appears at the resistor contacts. Such arcing disappears when the commutated resistor current i1 crosses the zero value (t7 or t8).

Generally speaking, the responsibility of the resistor commutating interrupter (main contacts) is more important than that of the resistor current cutting-off interrupter (resistor contacts). This is because, during the commutation, a large amount of fault current i0 must be interrupted and, in addition, the phase relation between voltage v0 and current i0 could be worse for this interrupting action (i.e., nearly 90 degrees phase difference could exist). For this reason, a large current handling capacity is required for the commutating interrupter.

On the contrary, the current handling capacity of the cutting-off interrupter may be far smaller than that of the commutating interrupter. This is because, the amount of current i1 to be interrupted by the cutting-off interrupter is far smaller than that by the commutation interrupter, and the phase of voltage v1 substantially matches the phase of current i1. However, when a small-current-capacity interrupter is employed for the cutting-off interrupter, the maximum period (TRmax) of a possible arc time of the resistor contacts is liable to exceed one cycle of current i1, as shown in FIG. 1.

Such a long arc time of the resistor contacts can be shortened if the current handling capacity of the cutting-off interrupter is enlarged. In this case, however, the mechanical power for driving or actuating the cutting-off interrupter is required to be further increased. (Conventionally, a power increase of 30 to 40% is required for the capacity-enlarged interrupter driving.) Then, the total size and cost of the circuit breaker body becomes large and, consequently, the manner of enlarging the current handing capacity of the cutting-off interrupter is not a good countermeasure.

Further, as exemplified in the illustration of FIG. 1, the minimum arc time TAmin* of the commutating interrupter (main contacts) under the rated gas pressure of, e.g., 6 kg/cm$^2$-g differs by roughly 0.2 cycles of current i0 from that TAmin under the interruption characteristic guaranteed pressure or interruption locking pressure of, e.g., 5 kg/cm$^2$-g. Such a minimum arc time difference (t3–t4) actually expands a possible current feeding period of the breaking resistor. Thus, when $SF_6$ interrupters are conventionally applied to the commutating and cutting-off interrupters, roughly 2 cycles (t3–t8) of current i1 should be considered for the maximum current feeding period TQ of the breaking resistor. This results in prominently enlarging the necessary heat capacity for the breaking resistor body.

SUMMARY OF THE INVENTION

It is accordingly an object of the present invention to provide a hybrid circuit breaker suitable for an EHV or UHV electric power system, in which the current feeding period for a breaking resistor at the time of a current interruption is shortened so that electric power to be dissipated by the breaking resistor decreases, thereby minimizing the necessary heat capacity of the breaking resistor and reducing the total size as well as the cost of the circuit breaker.

To achieve the above object, according to a hybrid circuit breaker of this invention, a vacuum interrupter (SR) is used for commutating the breaking resistor current and a means (16) for effecting this commutation is provided exclusively for the vacuum interrupter in order to shorten the maximum current feeding period (TQ) of the breaking resistor (R).

DETAILED DESCRIPTION OF THE PREFERRED EMBODIMENTS

In the following, preferred embodiments of this invention will be described with reference to the accompanying drawings.

Figure 1:
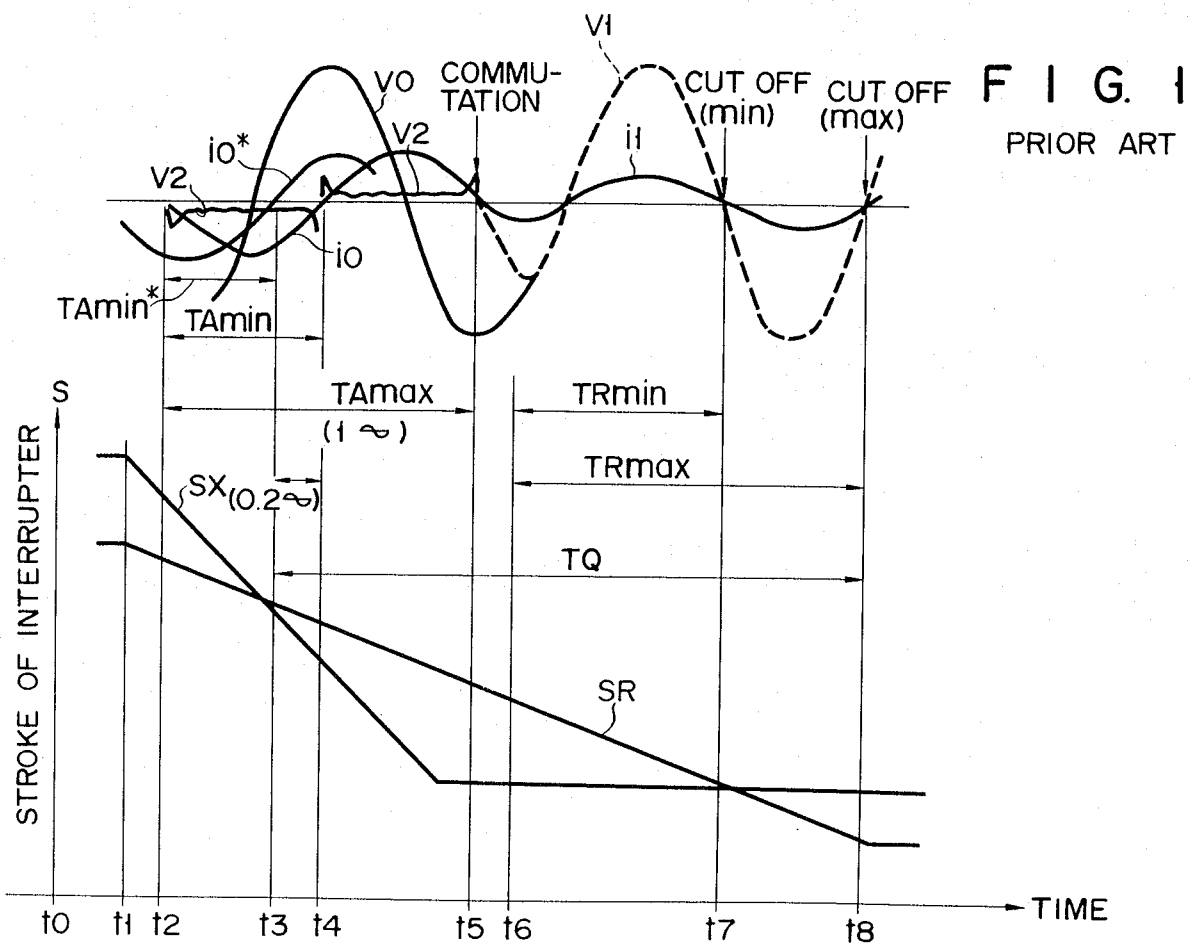
FIG. 1 PRIOR ART
FIG. 1 illustrates various voltage and current waveforms explaining a typical action of a conventional circuit breaker.
Figure 2:
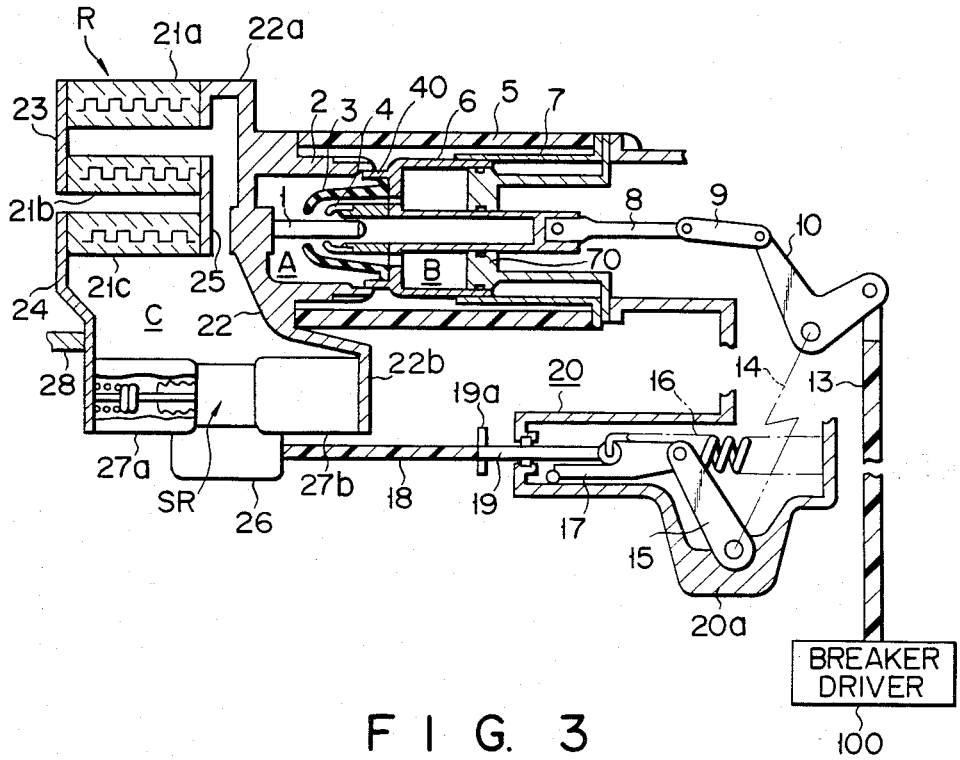
FIG. 2 is a sectional view of a hybrid circuit breaker according to an embodiment of the present invention, in which the circuit-closed state of the breaker is illustrated.
Figure 3:
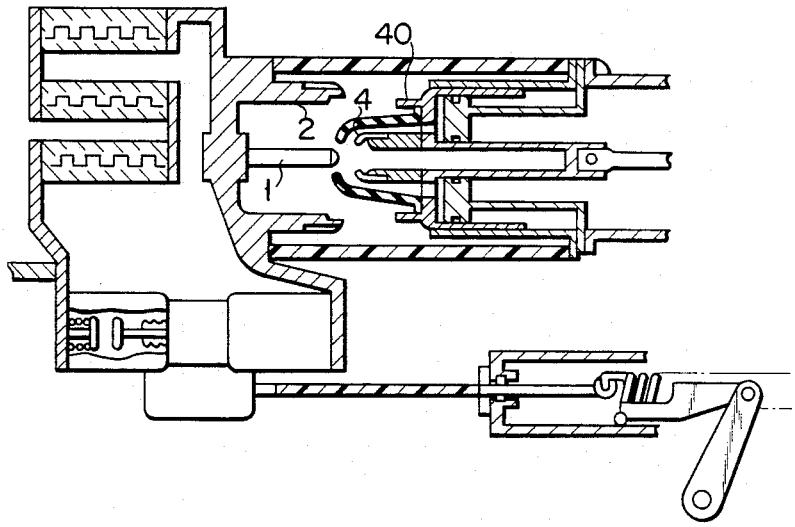
FIG. 3 is another sectional view of the circuit breaker in FIG. 2, in which the circuit-opened state of the breaker is illustrated.

FIG. 2 is a sectional view of a hybrid circuit breaker according to an embodiment of the present invention, in which the circuit-closed state of the breaker is illustrated. FIG. 3 is another sectional view of the FIG. 2 breaker, in which the circuit-opened state of the breaker is illustrated. In each of these figures, only one unit of serially connected hybrid circuit breakers is shown for the sake of simplicity.

As shown in FIGS. 2 and 3 a fixed electrode portion A is coupled in series to a parallel unit C. Portion A is formed with a fixed arc contact 1 and a fixed main conductor 2. Unit C is formed with a vacuum interrupter SR coupled in parallel to a breaking resistor R. Portion A faces a movable electrode portion B. Portion B is formed with an insulation nozzle 3, a movable arc contact 4, a movable main conductor 40 and a buffer cylinder 6. Contacts 1 and 4 constitute an arc switch SA, and conductors 2 and 40 constitute a main switch SM. Switches SA and SM constitute a main interrupter SX ($SF_6$ interrupter). Both electrode portions A and B are encapsulated within a cylinder body 5 which is made of an insulation material or forms a part of a voltage-dividing condenser.

The outer periphery of buffer cylinder 6 is coupled to one end of a collector finger 7. The other end of finger 7 is fixed at an end portion of cylinder body 5. Buffer cylinder 6 surrounds a buffer piston 70 whose end portion is also fixed at the end portion of cylinder body 5. One end of movable electrode portion B is pivotally coupled to one end of an insulated adjusting rod 13 via a coupling rod 8, link 9 and lever 10. The other end of rod 13 is coupled to a breaker driver 100 which may be a conventional one, thereby effecting the open/close action between electrode portions A and B.

One end of an electric conductor body 22 is coupled to fixed electrode portion A. Body 22 has conductor portions 22*a* and 22*b*. Portion 22*a* contacts one end of resistor R. Resistor R is formed with parallel arranged resistor bodies 21*a*, 21*b* and 21*c* (more than or less than three resistor bodies may be employed, of course). These resistor bodies are connected in series to one another via electric conductor members 23 and 25. The other end of resistor R contacts an electric conductor member 24 which is coupled to one side of vacuum interrupter SR. The other side of interrupter SR is connected through portion 22*b* to conductor body 22.

Vacuum interrupter SR is formed with vacuum interrupter valves 27*a* and 27*b*. Valve 27*a* is connected in series to valve 27*b* via a coupling member 26. The open/close actions of interrupter valves 27*a* and 27*b* are simultaneously effected by mechanical power transmitted through member 26. One electrode of interrupter SR (valve 27*a* side) is connected to conductor member 24. The other electrode of interrupter SR (valve 27*b* side) is connected to conductor portion 22*b*. Member 24 is connected via an electric connection member 28 to an electrically-insulated lead-out terminal (not shown).

Coupling member 26 of vacuum interrupter SR is coupled via an insulated adjusting rod 18 and adjusting rod 19 to a spring action member 20. Interrupter SR is actuated by mechanical power delivered from member 20. A stopper 19*a* is provided between adjusting rods 18 and 19. Member 20 is formed with a lever 15, link 17 and releasing spring 16. Lever 15 is coupled via a coupling shaft 14 to lever 10 which serves to control the open/close actions of electrode portions A and B. One end of link 17 is pivotally coupled to the free end portion of lever 15. Lever 15, spring 16 and link 17 are enclosed in a mechanism housing 20*a*.

At the time when vacuum interrupter SR is to be circuit-closed, releasing spring 16 is energized or precharged due to the swinging motion of lever 15. Link 17 serves to convert the swinging motion of lever 15 into a linear motion, to precharge the spring 16, and to effect the open/close actions of vacuum interrupter SR.

The operation of the above hybrid circuit breaker will be described below with reference to FIGS. 2 to 5.

Figure 5:
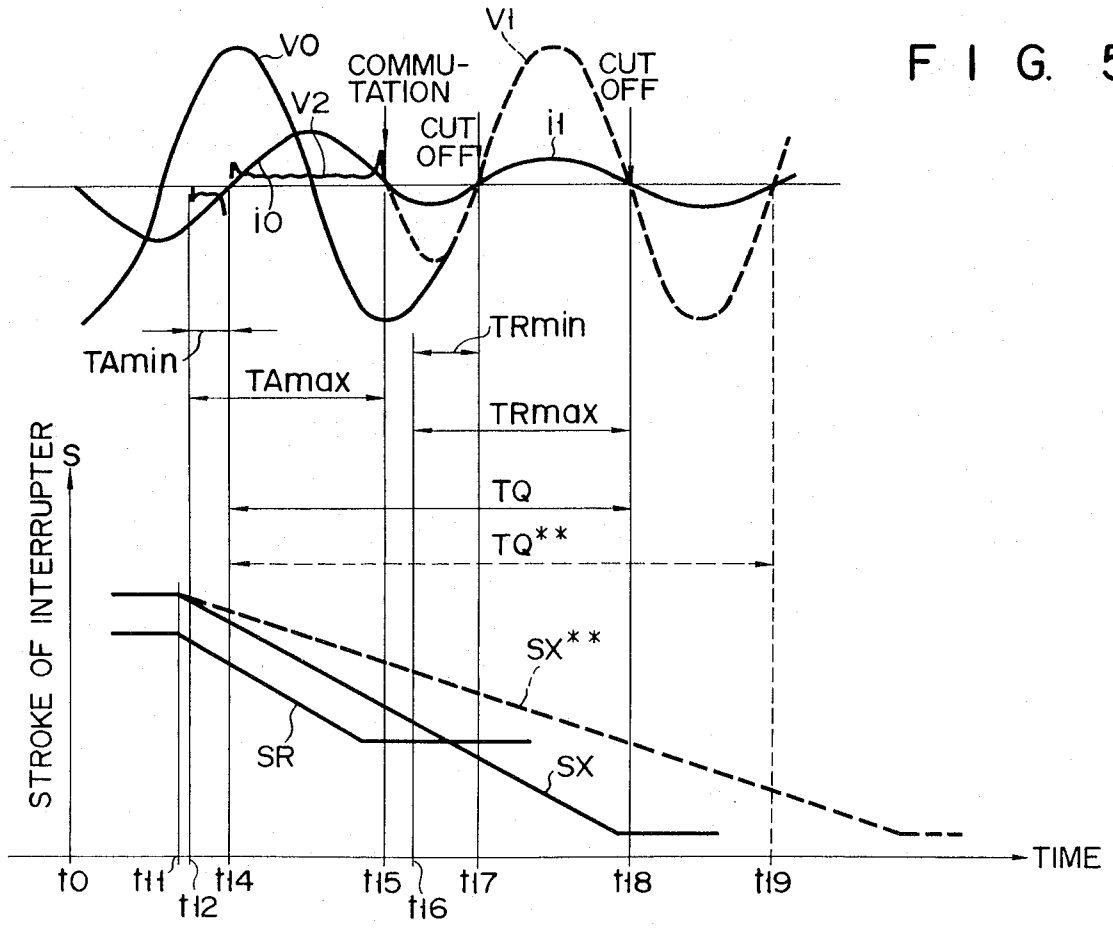
FIG. 5 shows waveforms explaining a current-interrupting action of the hybrid circuit breaker in FIG. 2.

In FIG. 5, v0 denotes the system voltage applied to the circuit breaker, v1 denotes a potential difference between contacts 1 and 4 of main interrupter SX, and v2 denotes an arc voltage appearing across the contacts of vacuum interrupter SR. Further, i0 denotes a breaker current to be interrupted by the breaker action, and i1 denotes a current flowing through breaking resistor R. SR denotes the stroke of vacuum interrupter SR for the resistor current commutation, and SX denotes the stroke of main interrupter SX for the resistor current cutting-off. SX denotes the stroke of interrupter SX under a condition that power for effecting the interrupting action of interrupter SX is small. TAmin indicates the minimum arc time of vacuum interrupter SR. TAmax indicates the maximum arc time of vacuum interrupter SR. TRmin indicates the minimum arc time of main interrupter SX. TRmax indicates the maximum arc time of main interrupter SX. TQ indicates the maximum current feeding period for breaking resistor R. TQ indicates the maximum current feeding period for breaking resistor R under a condition that power for effecting the interrupting action of interrupter SX is small.

Figures 4A, 4B, 4C, 4D, 4E, 4F, 8A, 8B, 8C, 8D, 8E, 8F:
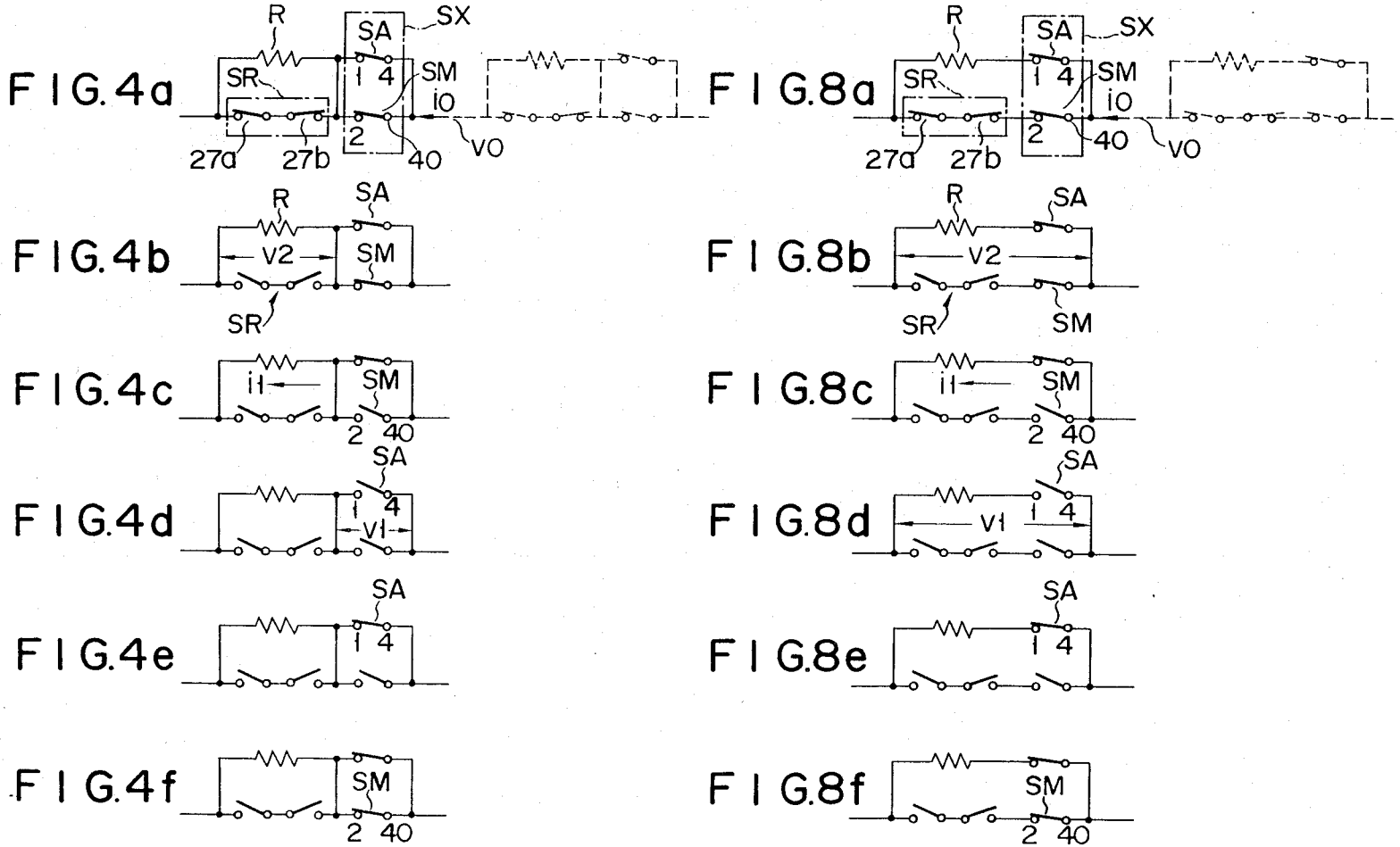
FIGS. 4*a* to 4*f* respectively show the circuit conditions of the FIG. 2 breaker, wherein FIGS. 4*a* to 4*d* explain the circuit-opening sequence of the FIG. 2 breaker and FIGS. 4*d* to 4*f* explain the circuit-closing sequence of the FIG. 2 breaker.
FIGS. 8*a* to 8*f* respectively show the circuit conditions of the FIG. 6 breaker, wherein FIGS. 8*a* to 8*d* explain the circuit-opening sequence of the FIG. 6 breaker and FIGS. 8*d* to 8*f* explain the circuit-closing sequence of the FIG. 6 breaker.

When an instruction for starting the current interruption is input to breaker driver 100 (FIG. 4*a;* t0 in FIG. 5), driver 100 renders insulated adjusting rod 13 pulled downward in FIG. 2. Then, lever 10 swings in the clockwise direction, and electrode portion B starts to deviate from electrode portion A (t11) so as to set an electrode-open state. With the above action, lever 15, which is mechanically linked via coupling shaft 14 to lever 10 and is swung with the same angular speed as lever 10, is also swung in the clockwise direction. Then, by means of the elastic energy being precharged in spring 16, insulated adjusting rod 18 renders vacuum interrupter SR to be circuit-opened quickly. In such a breaker action, in accordance with a preset wipe of the contacts of electrode portions A and B and with a preset wipe of the contacts of interrupter SR, interrupter SR is opened first (FIG. 4*b;* t12 in FIG. 5). Then, arcing appears at the contacts of vacuum interrupter SR. Following this, main conductors 2 and 40 of switch SM are opened second (FIG. 4*c:* between t12 and t16), and arc contacts 1 and 4 of switch SA are opened third (FIG. 4*d;* t16). During the above breaker action, the arc of vacuum interrupter SR disappears at a certain current i0 zero point, and breaker current i0 is commutated to breaking resistor R (t14 or t15).

If an axial magnetic field type vacuum interrupter as disclosed in, e.g., Japanese Pat. No. 1140613 (Japanese Patent Publication No. 54-22813) is used for interrupter SR, the available amount of breaker current interruption reaches 100 kA. When an axial magnetic field type vacuum interrupter is used, arcing generated between the respective contacts of vacuum interrupter valves 27*a* and 27*b* is subjected to a magnetic field being parallel to the arcing. By means of such an axial magnetic field type vacuum interrupter, it is possible to commutate the circuit current with a sufficiently short arc time.

To suppress a transient recovery voltage due to the interruption of fault current i0, current i1 starts to flow to resistor R after the disappearance of the arc of interrupter SR (t15). Then, arc contacts 1 and 4 of switch SA are separated or mechanically circuit-opened so that arcing appears (FIG. 4*d;* t16). In this case, if an axial magnetic field type vacuum interrupter having an excellent cutting-off characteristic is used for interrupter SR, current io is quickly commutated to resistor R.

Since the energy or power for the interrupting action of interrupter SR is obtained only from spring 16 (i.e., the interrupting energy does not depend on the output power from breaker driver 100), practically limited power from breaker driver 100 can be fully used for opening the electrode portions A and B, and the current cutting-off capacity of electrode portions A and B can be easily enlarged.

If the power from driver 100 is not fully used for opening the electrode portions A and B, the rate of change (dS/dt) of stroke SX becomes low and an arcing period is elongated to t19 (FIG. 5). On the contrary, when 100% of the driver output power is used, the rate of change (dS/dt) of stroke SX becomes relatively high so that the arcing period is shortened from t19 to t18 or t17. Thus, the maximum resistor current feeding period (TQ) after completion of the resistor current commutation can be minimized by fully utilizing the output power form driver 100**, thereby allowing sufficient reduction in the heat capacity of resistor R. In addition, by the use of vacuum interrupter SR, variations in arc time depending on the upper and lower limits of controlled gas-pressure are eliminated. Thus, it is not necessary to consider an excessively long current feeding period for breaking resistor R due to variations in the resistor current feeding period and, consequently, the heat capacity or the size of the resistor R body can be made small.

The circuit-closing of the breaker may be performed in a reverse manner of the circuit-opening. Namely, when breaker driver 100 starts to operate in the circuit-opened mode, fixed arc contact 1 and movable arc contact 4 of switch SA make contact with each other (FIG. 4*e*), and resistor R is temporarily connected to the electric power system so that an overvoltage caused by the circuit-closing of the breaker is damped. After a given period of time elapses, main switch SM is closed (FIG. 4*f*) according to a given preset wipe of conductors 2 and 40 and, at the same time of or slightly delayed from this main switch closing, vacuum interrupter SR is closed (FIG. 4*a*) so that resistor R is short-circuited. The circuit-closing action of the hybrid circuit breaker is thus completed.

In the above circuit-closing operation, releasing spring 16 of vacuum interrupter SR is elastically precharged through the mechanical action of lever 15 and link 17. This elastic energy precharged state of spring 16 is retained until the circuit-opening action is effected.

As mentioned above, when vacuum interrupter valves 27*a* and 27*b* are used for short-circuiting the resistor R at the time of breaker closing, or when valves 27*a* and 27*b* have responsibility for short-circuiting the breaking resistor R, a prearc due to a large circuit-closing current appearing in the duration of a faulty condition of an electric power system can be processed within quite a short arc time of vacuum interrupter SR. Accordingly, wearing of arc contacts 1 and 4 caused at every circuit-closing becomes negligible, and the interval for maintenance or inspection of contact members in main interrupter SX can be effectively expanded.

Figure 6:
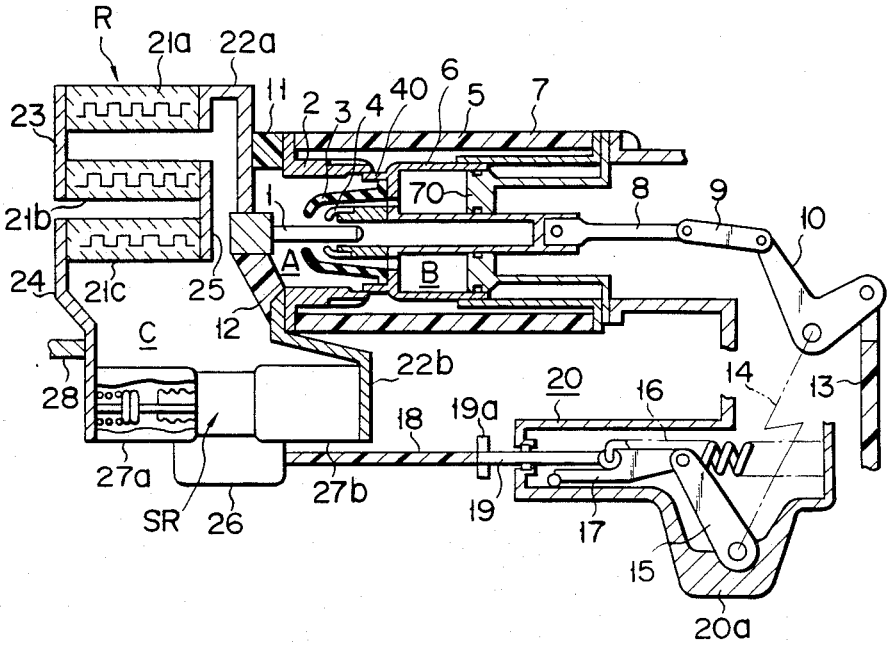
FIG. 6 is a sectional view of a hybrid circuit breaker according to another embodiment of the present invention, in which the circuit-closed state of the breaker is illustrated.
Figure 7:
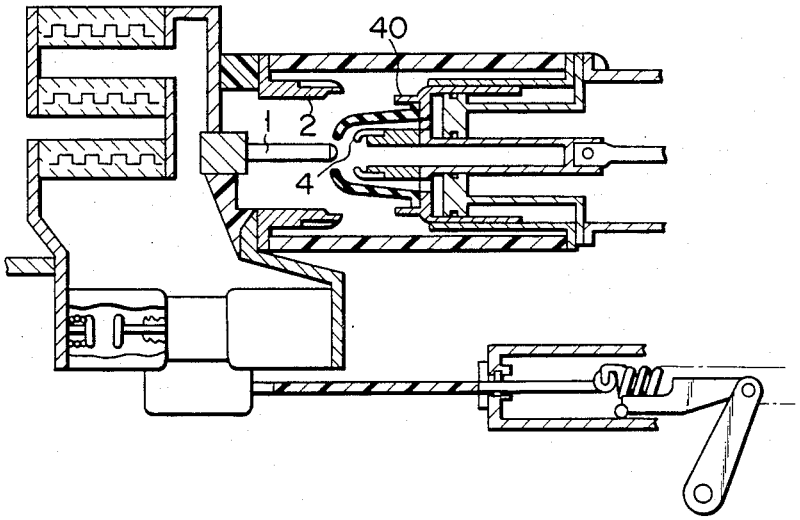
FIG. 7 is another sectional view of the circuit breaker in FIG. 6, in which the circuit-opened state of the breaker is illustrated.

FIGS. 6 and 7 show another embodiment of the invention. The basic configuration of this embodiment is substantially the same as that of the former embodiment in FIGS. 2 and 3. Accordingly, by assigning the same reference numerals to similar parts in these figures, redundant explanations will be avoided.

In FIGS. 6 and 7, fixed arc contact 1 is electrically insulated from fixed main conductor 2 by means of insulation members 11 and 12. Arc contact 1 is connected via conductor portion 22*a* to resistor body 21*a*. Main conductor 2 is connected via conductor portion 22*b* to vacuum interrupter valve 27*b*. Here, the wipe amount between main conductors 2 and 40 is predetermined such that during the current cutting-off process of main interrupter SX, the electrode-open timing between conductors 2 and 40 is identical to, or slightly delayed from, the electrode-open timing of vacuum interrupter SR.

A hybrid circuit breaker of FIG. 6 having the above configuration will operate as follows. When an interrupting instruction is generated from a breaker driver (not shown in FIG. 6) during the circuit-closed mode as shown in FIG. 6 (cf. FIG. 8*a*), vacuum interrupter SR is opened (FIG. 8*b*), main conductors 2 and 40 are opened (FIG. 8*c*), and arc contacts 1 and 4 are opened (FIG. 8*d*). In this case, since arc contact 1 is electrically insulated from main conductor 2 of fixed electrode portion A, when main conductors 2 and 40 are opened, the series circuit of vacuum interrupter SR and main switch SM is only subjected to the voltage appearing across resistor R. Because of this series circuit connection of SR and SM, the electric field stress of a recovery voltage for vacuum interrupter SR can be made lower than that in the case of FIG. 2. Thus, the reliability of the FIG. 6 embodiment is better than that of the FIG. 2 embodiment.

Incidentally, the operation sequence of the FIG. 6 embodiment with respect to the circuit-closing action may be the same as that performed in the FIG. 2 embodiment (cf. FIGS. 8*d*, 8*e*, 8*f* and 8*a*).

As mentioned above, according to a hybrid circuit breaker of the present invention, since a vacuum interrupter, whose interrupting action power is free from a breaker driver, is employed to effect the current commutation for a breaking resistor (i.e., the output power from a breaker driver can be fully utilized to a main interrupter), the current capacity of a main interrupter for cutting-off the commutated resistor current can be easily enhanced. From this, the current feeding period for the breaking resistor can be optimumly minimized, resulting the achievement of a reduction of 30% or more in the resistor heat capacity. In addition, due to a short arc time of a vacuum interrupter and because of small variations in the arc time thereof, the range of a period of time (TQ) to be considered for the resistor current feeding can be narrowed, thereby further reducing the resistor heat capacity.

In particular, generally speaking, the share in the volume of the breaking resistor body in a UHV circuit breaker is prominently large. Consequently, the reduction in the resistor heat capacity of 30% or more is quite effective to reduce the total size and cost of the circuit breaker. Furthermore, by assigning to a vacuum interrupter the responsibility of current-commutating, resistor-shunting and conducting for a fault current, the degree of wearing of the contacts in the main interrupter, of which insulation between the contacts has to be ensured, can be minimized. From this, deteriorating in the withstanding voltage of the contacts is practically avoided, and a circuit breaker having a high reliability for a long period of time can be obtained.

Finally, to support the disclosure of this application, the following documents are incorporated herewith:

U.S. Pat. No. 4,419,552 (Haginomori) issued on Dec. 6, 1983

U.S. Pat. No. 4,204,101 (Dethlefsen) issued on May 20, 1980

U.S. Pat. No. 4,087,664 (Weston) issued on May 2, 1978

While the invention has been described in connection with what is presently considered to be the most practical and preferred embodiment, it is understood that the invention is not to be limited to the disclosed embodiment but, on the contrary, is intended to cover various modifications and equivalent arrangements included within the scope of the appended claims which scope is to be accorded the broadest interpretation so as to encompass all such modifications and equivalent structures. For instance, when a plurality of the hybrid circuit breakers are used to constitute a series-connected breaker circuit, the breakers of FIGS. 2 and 6 may be joined. Namely, the FIG. 2 breaker may be connected in series to the FIG. 6 breaker. Further, the number of interrupter valves in the vacuum interrupter SR may be more than 2, if the withstanding voltage of interrupter SR is not sufficient.

What is claimed is:

1. A hybrid circuit breaker for interrupting a circuit current of an electric power system, comprising:

resistor means for damping or suppressing an overvoltage generated at said electric power system when said circuit current is interrupted;

first interrupter means for commutating said circuit current to said resistor means so that a resistor current corresponding to said circuit current flows through said resistor means;

second interrupter means coupled to said resistor means and to said first interrupter means for cutting-off said resistor current;

first actuation means for actuating said first interrupter means so that said circuit current is commutated to obtain said resistor current, wherein energy used for the action of said first actuation means is precharged before starting the interruption of said circuit current; and second actuation means for actuating said second interrupter means so that said resistor current is cut off at or after the start of the commutation of said circuit current, wherein energy used for the action of said second actuation means is delivered from a breaker driver which is adapted to said hybrid circuit breaker.

2. A hybrid circuit breaker according to claim 1, wherein said first interrupter means includes a vacuum interrupter.

3. A hybrid circuit breaker according to claim 2, wherein said vacuum interrupter includes a plurality of series-connected vacuum interrupter valves.

4. A hybrid circuit breaker according to claim 2, wherein said second interrupter means includes a gas interrupter.

5. A hybrid circuit breaker according to claim 2, wherein said second interrupter means includes:

a main contact portion coupled in series to said vacuum interrupter; and an arc contact portion coupled in series to said resistor means, the series circuit of said arc contact portion and resistor means being coupled in parallel to the series circuit of said main contact portion and vacuum interrupter.

6. A hybrid circuit breaker according to claim 2, wherein said second interrupter means includes:

a main contact portion coupled in series to said vacuum interrupter which is coupled in parallel to said resistor means; and an arc contact portion coupled in series to said resistor means and coupled in parallel to said main contact portion.

7. A hybrid circuit breaker according to claim 3, wherein two or more of said hybrid circuit breakers are connected in series which are used for interrupting a circuit current of an EHV or UHV electric power system.

8. A hybrid circuit breaker according to claim 1, further comprising:

means coupled to said first interrupter means and to said second interrupter means, for closing a current feeding path of said second interrupter means and, thereafter, short-circuiting said resistor means.

9. A hybrid circuit breaker according to claim 1, wherein said first actuation means includes a spring member to which an elastic energy is precharged, said elastic energy being used only to effect the commutation of said first interrupter means.

* * * * *